US007044442B2

(12) United States Patent
Belser

(10) Patent No.: US 7,044,442 B2
(45) Date of Patent: May 16, 2006

(54) VALVE BLOCK FOR A CONTROL DEVICE, PARTICULARLY FOR A HYDROSTATIC MACHINE

(75) Inventor: Roland Belser, Haigerloch (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 59 days.

(21) Appl. No.: 10/484,864

(22) PCT Filed: Jul. 16, 2002

(86) PCT No.: PCT/EP02/07909

§ 371 (c)(1),
(2), (4) Date: Sep. 15, 2004

(87) PCT Pub. No.: WO03/014570

PCT Pub. Date: Feb. 20, 2003

(65) Prior Publication Data

US 2005/0029484 A1 Feb. 10, 2005

(30) Foreign Application Priority Data

Jul. 26, 2001 (DE) ..... 101 36 416

(51) Int. Cl.
*F04B 49/00* (2006.01)
*F16K 1/00* (2006.01)

(52) U.S. Cl. ..... 251/176; 251/333

(58) Field of Classification Search ..... 251/176, 251/318, 324, 333
See application file for complete search history.

(56) References Cited

U.S. PATENT DOCUMENTS

| | | | | | |
|---|---|---|---|---|---|
| 1,689,974 | A | * | 10/1928 | Shallcross | 137/269 |
| 2,229,234 | A | | 1/1941 | Williams | |
| 2,299,234 | A | * | 10/1942 | Snader et al. | 417/222.1 |
| 2,641,871 | A | * | 6/1953 | Ray | 137/505.29 |
| 3,205,832 | A | | 9/1965 | Daub | |
| 3,662,986 | A | * | 5/1972 | Domulewicz, Sr. | 251/144 |
| 3,985,472 | A | * | 10/1976 | Virtue et al. | 417/216 |
| 4,050,477 | A | | 9/1977 | Acar | |
| 4,050,478 | A | * | 9/1977 | Virtue et al. | 137/625.66 |
| 4,331,045 | A | * | 5/1982 | Piech et al. | 477/114 |
| 4,355,761 | A | | 10/1982 | Bjorn et al. | |
| 4,760,866 | A | * | 8/1988 | Adler | 137/614.17 |

FOREIGN PATENT DOCUMENTS

| | | |
|---|---|---|
| DE | 199 53 170 A1 | 5/2001 |
| GB | 1013680 | 12/1965 |
| WO | WO 03/014570 A1 | 2/2003 |

* cited by examiner

*Primary Examiner*—J. Casimer Jacyna
(74) *Attorney, Agent, or Firm*—Scully, Scott, Murphy & Presser

(57) ABSTRACT

The invention relates to a valve block (1) for a control device comprising a valve (9) whose valve piston (14) is subjected to the action of a control pressure when in its open position and to the action of a return spring (15) when in its closed position. The closing force of the return spring (15) can be decreased or increased by an actuator, which can be displaced toward a position that increases the closing force and one that decreases the closing force. In order to simplify the displacement or adjustment and to improve reliability, the displacing movement of the actuator (16*a*) in the direction of movement that increases the closing force of the return spring (15) is limited by a stop element (112) in a position in which the closing force of the return spring (15) reaches its limited maximum value.

11 Claims, 2 Drawing Sheets

VALVE BLOCK FOR A CONTROL DEVICE, PARTICULARLY FOR A HYDROSTATIC MACHINE

The invention relates to a valve block according to the preamble of claim 1.

A valve block of this kind is described in DE 199 53 170 A1. In this known valve block for a hydraulic pump, a power control valve and a control valve are provided, the latter being subjected to the action of actuating pressure as a function of the difference between the working pressure in a working line of the hydraulic pump and the pressure flow upstream of the power control valve in a power control line of an adjusting device for the hydraulic pump. In addition, the control valve can be subjected to a variable additional force by means of an actuator. It is thereby possible to adjust the maximum power which is limited by the control valve in conjunction with the power control valve and therefore to reduce or increase the maximum power in dependence on the operating situation.

It is the object of the invention to simplify adjustment and to improve reliability in a valve block according to the preamble of claim 1.

This object is achieved by the features of claim 1. Advantageous refinements of the invention are described in the dependent claims.

In the valve block according to the invention, the adjusting movement of the actuator in its direction of movement which increases the closing force is limited by a stop element in a position in which the closing force corresponds to its limited maximum value. Adjustment of the valve block or of a hydrostatic machine equipped with the valve block to values which could cause overload or damage is thereby prevented. The operator can adjust the hydrostatic machine only to a maximum value, in particular a pressure value, which corresponds to a given maximum admissible value, e.g. the maximum admissible actuating pressure or working or operating pressure. Consequently, the configuration according to the invention also leads to a simplification of the adjustment of the displacing device. This is because the operator does not need to direct any particular attention to when or whether the adjustment corresponds to or exceeds a maximum admissible criterion.

Features contained in the dependent claims give rise to configurations which are advantageous for reasons of simple and cost-effective production and/or assembly or dismantling, and which in addition simplify and improve operation, while yielding configurations of small size which can be simply integrated.

The configuration according to the invention is suitable for devices including a pressure control device and/or a delivery flow control device.

It is advantageous to arrange the stop element and the actuator on an add-on part of the valve block. It is thereby possible to prefabricate or pre-assemble the add-on part not only with respect to the actuator but also with respect to the stop element, so that it is only necessary to install the add-on part on the valve block to complete the valve according to the invention.

Further features of the invention relate to an adjusting plate in the form of a spring plate the edge of which is reduced on both sides in such a way that the adjusting plate can be installed in a radially widened end portion of a blind hole in the add-on part.

A further advantage of the configuration according to the invention is that it can be easily combined with existing constructions and integrated therein.

A preferred embodiment of the invention is described in detail below with reference to the drawings, in which.

Figure 1:
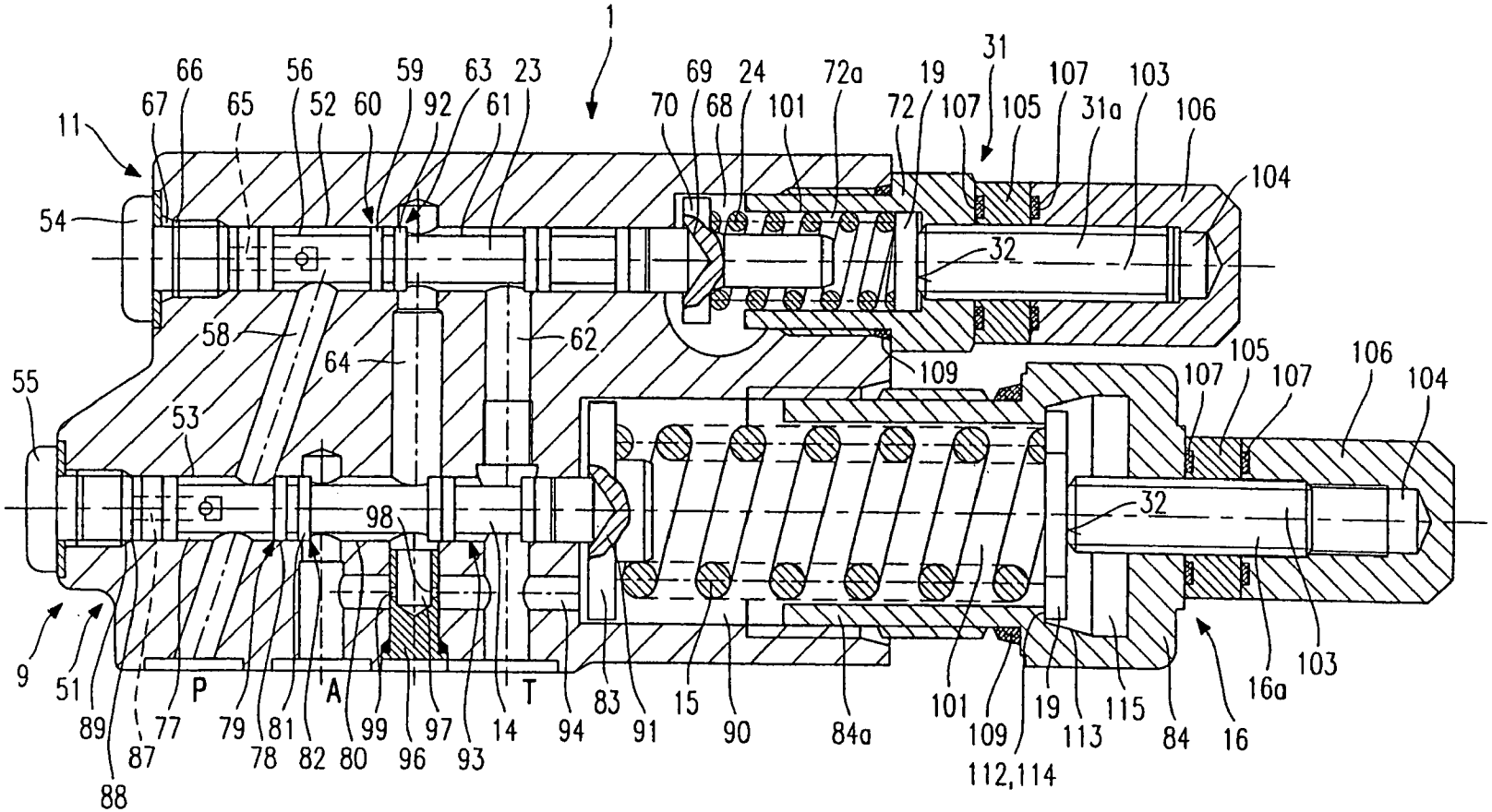
FIG. 1 shows a valve block according to the invention for a hydraulic control device having two valves.
Figure 2:
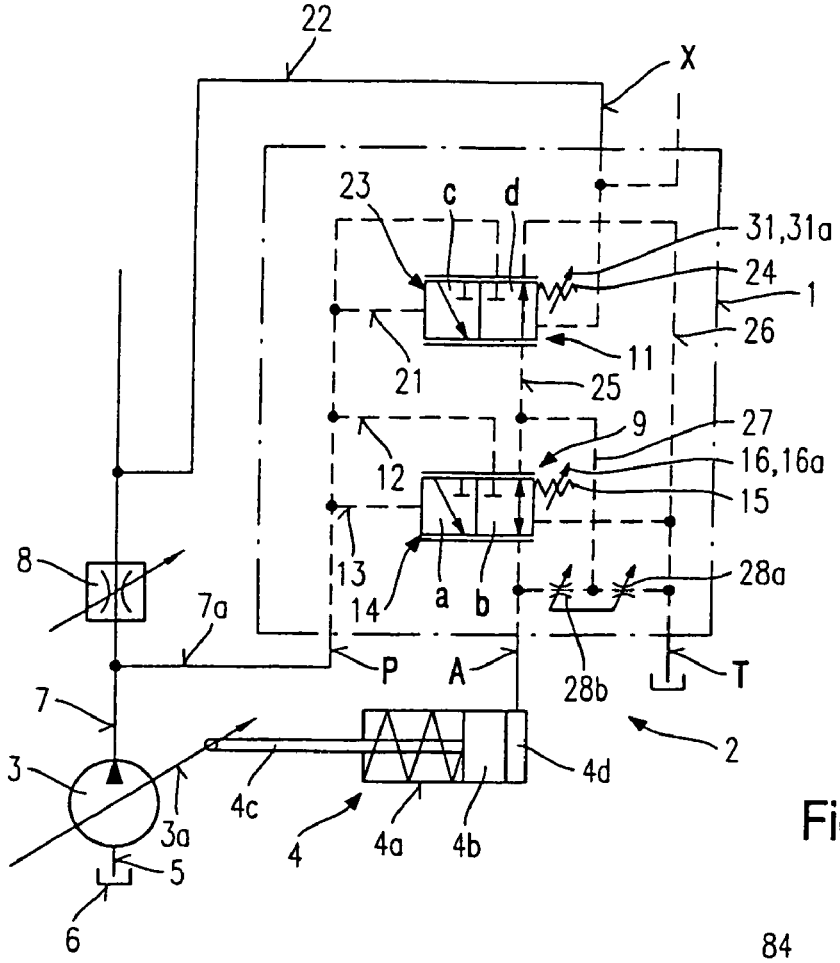
FIG. 2 shows a schematic hydraulic circuit diagram of the valve block.
Figure 3:
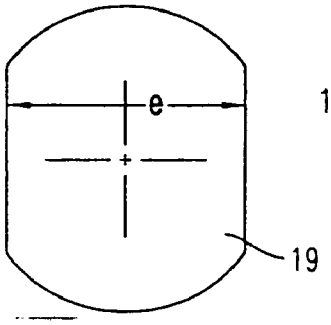
FIG. 3 is an axial view of an adjusting plate.

The valve block designated by reference numeral 1 in FIGS. 1 and 2 forms part of an adjusting device, denoted as a whole by 2, for controlling and adjusting the throughput volume of a hydrostatic machine, in this case a hydraulic pump 3. The adjusting device 2 has an adjusting cylinder 4 which in the present embodiment is hydraulically single-acting and comprises in known fashion a cylinder 4*a*, a piston 4*b* displaceably mounted therein and a piston rod 4*c* which is connected to the pump 3 by an adjusting element 3*a* shown only indicatively. Within the scope of the invention the hydrostatic machine can be formed by a hydraulic motor of adjustable throughput volume in place of a hydraulic pump 3.

As is shown in FIG. 1 and in particular in FIG. 2, the valve block 1 has at least four hydraulic connections, namely a working pressure connection P, an actuating pressure connection A, a tank connection T and a control connection X. The hydraulic pump 3 is drivingly connected to a drive shaft of a drive motor (not shown), e.g. an internal combustion engine. In operating mode, the hydraulic pump 3 draws hydraulic fluid through a suction line 5 from a hydraulic fluid tank 6 and delivers the hydraulic fluid to a working line 7, in which an optionally adjustable delivery flow throttle 8 is arranged.

Within the scope of the invention, the valve block 1 may have only one valve 9. In the present embodiment, two valves 9, 11 are provided, of which the valve 9 is a pressure control valve and the valve 11 is a delivery flow control valve. An inlet of the pressure control valve 9 is connected via a connecting line 12 to a working line branch 7*a* which branches from the working line 7 upstream of the delivery flow throttle 8. The valve piston 14 of the pressure control valve 9 can be subjected to the action of the working pressure via a connecting line 13 connected to the working line branch 7*a*, against the force of a return spring 15, the spring force of which can be selectively reduced and increased by means of an actuator 16*a* of an adjusting device 16.

The delivery flow control valve 11 is connected via a first connecting line 21 to the working line 7 upstream of the delivery flow throttle 8 or to the working line branch 7*a*, and is connected via a second connecting line 22 to the working line 7 downstream of the delivery flow throttle 8. As long as the working pressure in the working line 7 does not exceed a given value the displacement volume of the hydraulic pump 3 is so adjusted by the adjusting device 2 or the adjusting cylinder 4 that a constant delivery flow passes through the delivery flow throttle 8. To this end, the delivery flow control valve 11 is subjected via the connecting lines 21, 22 to the action of the pressure drop at the delivery flow throttle 8. If the pressure drop at the delivery flow throttle 8 increases correspondingly to delivery flow passing through the delivery flow throttle 8, the valve piston 23 of the delivery flow control valve 11 is displaced against a return spring 24 from its first valve position d to its second valve position c. The actuating pressure in the actuating pressure chamber 4*d* of the adjusting cylinder 4 is therefore controlled via the actuating pressure line 25. Upon displacement to the valve position c, the actuating pressure in the actuating pressure chamber 4*d* of the adjusting cylinder 4 is increased and the displacement volume of the hydraulic pump 3 is swivelled back in the direction of a smaller displacement volume. The delivery flow passing through the delivery flow throttle 8, and therefore the pressure drop at the delivery flow throttle 8, are thereby reduced in their turn, so that a state of equilibrium is established at the delivery flow control valve 11. The delivery flow, which is determined by the consumer connected to the working line 7, can be varied by changing the cross-section of the preferably adjustable delivery flow throttle 8.

The pressure control valve 9, which in its position b is connected by two connections to the actuating pressure line 25, comes into operation when the working pressure exceeds a predefined value. In this case the valve piston 14 is displaced from the first valve position b illustrated to the second valve position a, in which position the section of the actuating pressure line 25 extending to the actuating pressure chamber 4*d* is connected to the connecting line 12 and to the working line branch 7*a*. The actuating pressure to which the actuating pressure chamber 4*d* is subjected is thereby increased and the displacement volume is regulated to a value which yields a working pressure which does not exceed the predefined value. The delivery flow control valve 11 has a connection which is connected via a connecting line 26 to the tank 6, and which in the valve position d corresponds to the connection for the actuating pressure line 25.

Between the valves 9, 11 the actuating pressure line 25 is connected via a connecting line 27 having a first relief throttle 28*a* to the tank 6. Downstream of the pressure control valve 9, the actuating pressure line 25 or the actuating pressure chamber 4*d* is optionally connected via a second relief throttle 28*b* to the first relief throttle 28*a* and via the latter also to the tank 6.

In the present embodiment, the delivery flow control valve 11 and the pressure control valve 9 in each case take the form of a 3/2-way valve.

Like the pressure control valve 9, the delivery flow control valve 11 also has an adjusting device 31 with an actuator 31*a* with which the spring force of the return spring 24 can be selectively reduced or increased.

The actuators 16*a*, 31*a* are selectively movable back and forth and are mounted fixably in the particular adjustment position adopted. The direction of movement of the actuators 16*a*, 31*a* is preferably in the longitudinal direction of the associated respective valve pistons 14, 23.

In the present embodiment, the actuators 16*a*, 31*a* are manually adjustable. However, they may also be power-adjustable, e.g. by means of an electromagnetic, in particular a proportional magnet.

In the present embodiment, the actuators 16*a*, 31*a* act axially on an abutment 32 of the associated respective return spring 15, 24, the abutment 32 being preferably formed by a support plate 19 in the form of a spring plate, as will be described below with reference to FIG. 1, which shows a compact and therefore, for this reason among others, advantageous configuration of the valve block 1.

A first transverse drill hole 52 for the delivery flow control valve 11 and a second transverse drill hole 53 parallel thereto for the pressure control valve 9 are formed in a main body 51 of the valve block 1. The transverse drill holes 52, 53 are occluded by respective threaded plugs 54, 55. The valve piston 23 of the delivery flow control valve 11 is mounted axially displaceably in the first transverse drill hole 52. The valve piston 23 has a first annular recess 56 which is connected via a connecting passage 58 to the working pressure connection P. Adjoining the annular recess 56 is a zone 59 of increased diameter on which a first control edge 60 is formed. In addition, the valve piston 23 has a second annular recess 61 which is connected via a connecting passage 62 to the tank connection T. Adjoining the second annular recess 61 is a zone 92 of increased diameter on which a second control edge 63 is formed.

Because the valve piston 23 of the delivery flow control valve 25, in its rest position illustrated in FIG. 2, is displaced to the left by the associated return spring 24 in FIG. 1, the second control edge 63 is open and a connecting passage 64 is connected via the connecting passage 62 to the tank connection T. The annular recess 56 is connected via a longitudinal bore 65 formed in the valve piston 23 to a first pressure chamber 67 formed between a first pressure working face 66 and the occluding plug 55. The pressure working face 66 formed by the left-hand end face of the valve piston 23 is thereby subjected to the action of the working pressure. The control pressure supplied via the delivery flow control connection X (not shown in FIG. 1) of a second pressure chamber 68 acts on a second pressure working face 69, which forms the right-hand end face of the valve piston 23. The return spring 24 also acts on this end face of the valve piston 23 via a spring plate 70.

The increase in the restoring force generated by the actuator 31*a* is transmitted to the valve piston 23 via the support disc 19 and the return spring 24. The valve piston 23 therefore so adjusts itself that the actuating force exerted by the working pressure is in equilibrium with the opposing force exerted by the return spring 24.

The valve piston 14 for the pressure control valve 9 is inserted in the second transverse bore 53. The valve piston 14 has a first annular recess 77 which is connected via the connecting passage 58 to the working pressure connection P.

Adjoining the first annular recess 77 is a zone 78 of increased diameter on which a first control edge 79 is formed. A second annular recess 80 which is connected to the connecting passage 64 is also formed on the valve piston 14. Adjoining the second annular recess 80 is a zone 81 of increased diameter on which a second control edge 82 is formed. In the rest position illustrated the second valve piston 14 is pressed by the return spring 15 against its left-hand stop in FIG. 1, so that the second control edge 82 is open. The return spring 15 bears against a spring disc 83 which is held in abutment against the valve piston 14. The actuator 16*a*, which is accessible from outside and with which the axial position of the support disc 19 and therefore the preload of the second return spring 15 can be changed, is located in the receiving body 84 screwed into the main body 51.

Located in the valve piston 14 is a longitudinal bore 87 in the form of a blind hole which opens at a third pressure chamber 88 formed between the occluding plug 54 and the valve piston 14, so that the third pressure chamber 88 is connected to the working pressure connection P. The working pressure acts on a first pressure working face 89 of the valve piston 14. The equilibrium position of the valve piston 14 is therefore determined by the difference between the force generated by the working pressure and the restoring force of the return spring 15.

The valve body 14 has a through-feed 93 in the region of the connecting passage 62.

A longitudinal bore 94 extends from the fourth pressure chamber 90 to the actuating pressure connection A. An occluding plug 96 in which a blind hole 97 is formed is located in the area of interpenetration between the connecting passage 64 and the longitudinal bore 94. The blind hole 97 is connected via a first transverse bore 98, which forms the first relief throttle, to the tank connection T. In addition, the blind hole 97 is connected via a second transverse bore 99, which forms the second relief throttle, to the actuating pressure connection A. By rotating the occluding plug 96, the cross-section of the aperture resulting from the overlapping of the transverse bores 98 and 99 with the cross-section of the longitudinal bore 94 can be adjusted.

The adjusting devices 16, 31 are arranged on respective receiving bodies 72, 84 which are add-on parts, in particular screw-in parts, of the main body 51. The receiving bodies 72, 84 have in each case an axial through-hole having two through-hole sections 101, 102. The through-hole section 101 facing towards the main body 51 serves to receive the respective associated return spring 15, 24. The through-hole section 102 facing away from the main body 51 serves to receive the respective associated actuator 16*a*, 31*a*. In the present embodiment, the actuators 16*a*, 31*a* are in each case formed by a spindle drive the adjusting screw 103 of which is screwed into the through-hole section 102, which is configured as a threaded hole, and is axially adjustable by rotation. The respective adjusting screw 103 is accessible from outside on a rotationally engaging element (not shown), e.g. a slot or a hexagon for a screwdriver, and is lockable by means of a screwed-on locknut 105 which in the present embodiment bears against the respective receiving body 72, 84.

The end section of the adjusting screw 103 projecting beyond the locknut 105 is covered by a screwed-on cap 106 which is provided for the purpose of mechanical protection and/or sealing. The cap 106 has at its threaded-hole edge a preferably radial end face with which it abuts a preferably radial end face of the locknut 105. Radial end faces are preferably also provided between the locknut 105 and the respective receiving body 72, 84. The abutting end faces can in each case be sealed by an annular seal, e.g. an O-ring of elastic material, which is arranged in an annular groove arranged in the associated end face of the cap 106 or the locknut 105 or the receiving body 72, 84. In the screwed-together state the sealing ring 107 is elastically compressed, whereby the seal is obtained. In the end portion of the threaded hole of each cap 106 a cavity 104 ensuring adjustability for the associated adjusting screw 103 is present for the associated adjusting screw 103.

A support plate 19 on which the respective return spring 15, 24 bears is arranged between each actuator 16*a*, 31*a* and the respective return spring 15, 24.

In the present embodiment, the receiving bodies 72, 84 are formed by screw-in parts which are screwed by means of a respective threaded bush 72*a*, 84*a* surrounding the inner through-hole section 101 into a corresponding threaded hole in the main body 51 and optionally abut with the shoulder face of a widened head against the main body 51. To seal this screw connection also, an annular seal, preferably a special sealing ring 109, may be provided in the edge area of the screw-insertion hole.

In the case of the pressure limiting valve 9, the support plate 19 and its surrounding area in the receiving body 84 have a special configuration, as elucidated below.

The support plate 19 is located in an axial adjustment area in the transition area between the bore sections 101, 102. In the displacement direction of the actuator 16*a* which increases the closing or restoring force of the return spring 15 the displacement range for the support plate 19 is limited by a stop 112 which is located in an axial position in which the pressure control valve 9 sets or limits a pressure, in this case the actuating pressure, which corresponds to the maximum admissible pressure. The hydraulic pump 3 is thereby effectively protected from overloading.

Figure 4:
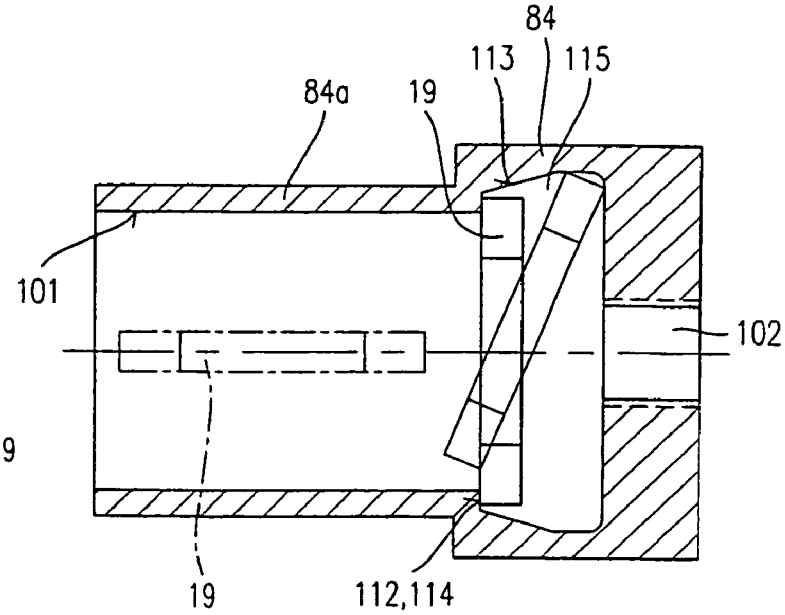
FIG. 4 shows a receiving body with the adjusting plate in axial section.

In the present embodiment, the stop 112 is formed by a step face 114 facing away from the main body 51 on the inner through-hole section 101, the step face 114 bordering a widened hole section 115 which is located between the through-hole sections 101, 102. To be able to install the support plate 19 it is reduced, preferably flattened, on both sides to a dimension e which is smaller than the cross-sectional dimension of the inner through-hole section 101. Consequently, the support plate 19 can be moved through the through-hole section 101 into the widened hole section 115 when in a position rotated through 90° with respect to the stop 112. The widened hole section 115 is formed with respect to its axial and radial dimensions in such a way that the support plate 19 can be swivelled into its operating position, in which it is disposed parallel to the stop 112, in the widened bore section 115. The widened hole section 115 has at least in its axial portion facing towards the stop 112 a preferably conical internal surface 113 which converges towards the stop 112. By means of this convergent internal surface 113 the support plate 19 is centred when moving towards the stop 112, if it has adopted an eccentric position when swivelling. In FIG. 4 the support plate 19 is shown in a plurality of intermediate swivelling positions.

It is possible within the scope of the invention to form the stop 112 or the stop element by a spring washer which is inserted in an annular groove in the internal surface of the inner through-hole section 101. To install the support plate 19, the size of which in this case is adapted with free play to the cross-sectional dimension of the hole section 101, the support plate 19 is first pushed into the through-hole section 101 and the spring washer 116, which projects beyond the internal surface of the through-hole section 101 and can therefore serve as the stop 112, is then installed. In this configuration, the support plate 19 can be circular.

The invention is not restricted to the embodiment illustrated. In particular, an electromagnet or an electric motor, in particular a stepper motor, which changes, e.g. by means of a threaded spindle, the preloading of the return springs 15, 24, and therefore the additional force exerted on the respective valve pistons 14, 23, may be used for power-driven adjustment of the actuator 16*a* or 31*a*.

Although not illustrated in FIG. 1, the support plate 19 of the delivery flow regulating valve 11 and its surrounding area in the receiving body 72 may also be configured as described above with reference to the pressure control valve 9. The above-described stop-limit for the maximum value of the restoring or closing force of the return spring can therefore also be realised in a corresponding configuration of the delivery flow control valve 11 or another valve.

The invention claimed is:

1. Valve block (1) for a control device, in particular for a hydrostatic machine, comprising a valve (9) the valve piston (14) of which is subjected to the action of a control pressure when in its open position and to the action of a return spring (18) when in its closed position, the closing force of the return spring (15) being able to be reduced or increased by means of an actuator (16*a*) which can be displaced towards a position which increases the closing force and a position which reduces the closing force, characterised in that the displacing movement of the actuator (16*a*) in the direction of movement which increases the closing force of the return spring (15) is limited by a stop element (112) in a position in which the closing force of the return spring (15) reaches its limited maximum value.

2. Valve block according to claim 1, characterised in that the stop element (112) is formed by a step face (114) facing away from the valve piston (14) in a receiving hole (101) receiving the return spring (15).

3. Valve block according to claim 2, characterised in that the return spring (15) bears against a support plate (19) against which the actuator (16*a*) acts, and cooperates with the stop element (112).

4. Valve block according to claim 3, characterised in that the step face (114) borders a widened hole section (115) in which the support plate (19), which is dimensioned larger than the receiving hole (101), is arranged.

5. Valve block according to claim 3 or 4, characterised in that the actuator (16*a*) is arranged axially movably in a preferably coaxial hole section (102) on the side of the support plate (19) facing away from the valve piston (14).

6. Valve block according to claim 5, characterised in that the support plate (19) is reduced on opposite sides to a width dimension (e) which is smaller than the cross-sectional dimension of the receiving hole (101), and the widened hole section (115) is sufficiently large for the support plate (19) to be swivellable in the widened hole section (115).

7. Valve block according to claim 5, characterised in that the actuator (16*a*) is formed by a screw drive having an adjusting screw (103) which is screwed into the outer hole section (102).

8. Valve block according to claim 1, characterised in that the stop element (112) and the actuator (16*a*) are arranged in an add-on part (84) of the valve block (1).

9. Valve block according to claim 8, characterised in that the add-on part (84) is connected to the valve block (1) by a screw connection.

10. Valve block according to claim 1, characterised in that the valve is a pressure control valve (9), e.g. a pressure limiting valve, or a delivery flow control valve (11).

11. Valve block according to claim 10, characterised in that the pressure control valve (9) or the delivery flow control valve (11) is arranged in an actuating pressure line (24) which extends to an adjusting cylinder (4) which is provided to adjust the displacement volume of the hydrostatic machine.

* * * * *